US006494416B2

(12) United States Patent
Wang

(10) Patent No.: US 6,494,416 B2
(45) Date of Patent: Dec. 17, 2002

(54) GOLF BAG SUPPORT

(76) Inventor: Bae-Luh Wang, P.O. Box 487, Chang-Hua City 500 (TW)

( * ) Notice: Subject to any disclaimer, the term of this patent is extended or adjusted under 35 U.S.C. 154(b) by 0 days.

(21) Appl. No.: 09/755,126

(22) Filed: Jan. 8, 2001

(65) Prior Publication Data

US 2002/0043475 A1 Apr. 18, 2002

(30) Foreign Application Priority Data

Oct. 12, 2000 (TW) ..... 089217641 U

(51) Int. Cl.[7] ..... A63B 55/00; F16M 11/38

(52) U.S. Cl. ..... 248/96; 248/166; 248/168; 248/170

(58) Field of Search ..... 248/96, 166, 168, 248/170; 206/315.7, 315.8

(56) References Cited

U.S. PATENT DOCUMENTS 5,209,350 A * 5/1993 Meang ..... 206/315.7
5,415,285 A * 5/1995 Reimers ..... 206/315.7
5,681,016 A * 10/1997 Wang ..... 248/96
5,860,521 A * 1/1999 Wu ..... 206/315.7
5,901,845 A * 5/1999 Cheng ..... 206/315.7
6,010,101 A * 1/2000 Stein ..... 248/96
6,220,433 B1 * 4/2001 Kang ..... 206/315.7
6,241,201 B1 * 6/2001 Wang ..... 248/96
6,298,988 B1 * 10/2001 Wen-Chien ..... 206/315.7
6,311,938 B1 * 11/2001 Lin ..... 248/96
6,315,117 B1 * 11/2001 Han ..... 206/315.7
6,325,208 B1 * 12/2001 Cheng ..... 206/315.7

* cited by examiner

*Primary Examiner*—Ramon O. Ramirez
*Assistant Examiner*—Amy J. Sterling

(57) ABSTRACT

A support device for golf bag comprises an elongate attachment means secured to the golf bag, the attachment means including an enlargement on either end; a leg pivotal on either end of the attachment means and including a sleeve having an extension, and a joint including a top coupling member and a recessed portion such that the coupling member is fitted into the enlargement and pivotably secures the leg to the attachment means; a rod including two upper hooks each secured to the extension and a lower pivotal member; a base having a recess on the underside of a cut-out portion; and a support means including a flexible member, an L-shaped member secured to the pivotal member and an abutment member conformed to the recess. Upper part of flexible member is secured between recess and abutment member, while lower part thereof is secured to horizontal portion of L-shaped member.

1 Claim, 9 Drawing Sheets

GOLF BAG SUPPORT

FIELD OF THE INVENTION

The present invention relates to the field of golf bag and more particularly to a golf bag support with improved characteristics.

BACKGROUND OF THE INVENTION

A conventional golf bag with support device comprises a bag, two legs pivotably attached to bag, and a support pivotably attached to legs. In use, user may pull bag outward to form an angle with respect to legs (i.e., inclined) for stably placing bag on the ground. However, the previous design suffered from two disadvantages:

1. It is not an aesthetic design because base is disposed between extended legs and bag.
2. It is not stable due to the flat surface contact between base and ground. In practice, golf bag is susceptible to fall when an object collides with it.

Thus, it is desirable to provide an improved golf bag support in order to overcome the above drawbacks of prior art.

SUMMARY OF THE INVENTION

It is an object of the present invention to provide a support device for golf bag comprising an elongate attachment means secured to the back of the upper part of the golf bag, the attachment means including an enlargement on either end, each enlargement having a slot and a wedge inside the slot; a pair of legs pivotably provided on either end of the attachment means, each leg including a sleeve below the top end by a predetermined distance, the sleeve having a side extension, and a joint put on the upper part, the joint including a coupling member on the top having a length about equal to that of the slot and a recessed portion conformed to the wedge such that the coupling member of the joint is capable of fitting into the enlargement and pivotably securing the leg to the attachment means; an extension rod including a pair of flexible hooks on the upper end each secured to the side extension of the sleeve and a pivotal member on the lower end; a base secured to the bottom of the golf bag being substantially a cylindrical member with a cut-out portion, the base having a recess on the underside of the cut-out portion; and a support means including a flexible member, a substantially L-shaped member having two spaced posts for pivotably securing the pivotal member of the extension rod, and an abutment member conformed to the recess of the base, wherein the upper portion of the flexible member is secured between the recess of the base and the abutment member and the lower portion of the flexible member is secured to the horizontal portion of the L-shaped member. The golf bag is stable when standing.

The above and other objects, features and advantages of the present invention will become apparent from the following detailed description taken with the accompanying drawings.

DETAILED DESCRIPTION OF THE PREFERRED EMBODIMENTS

Figure 1:
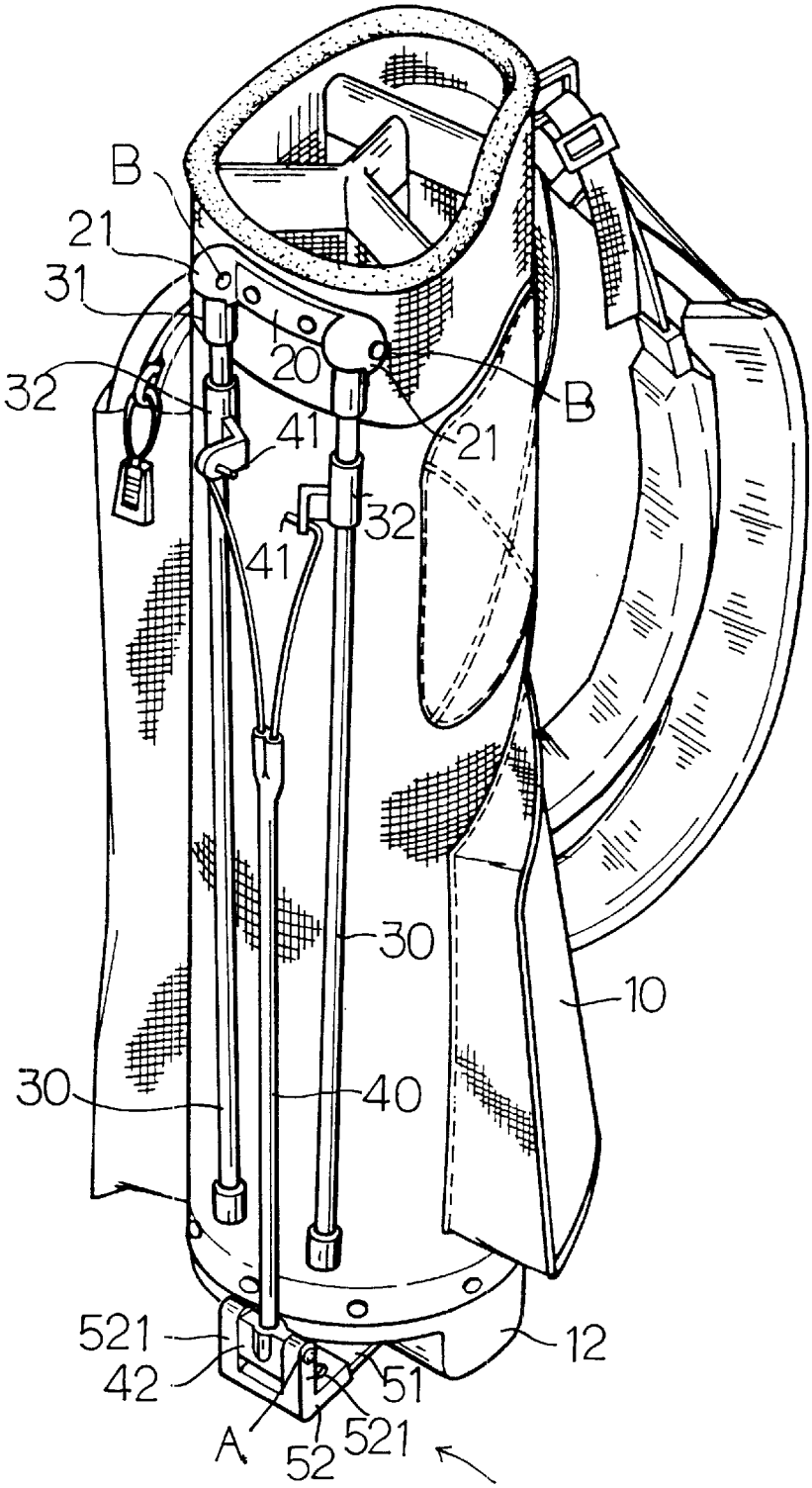
FIG. 1 is a perspective view of a first preferred embodiment of golf bag support according to the invention mounted in golf bag.
Figure 2:
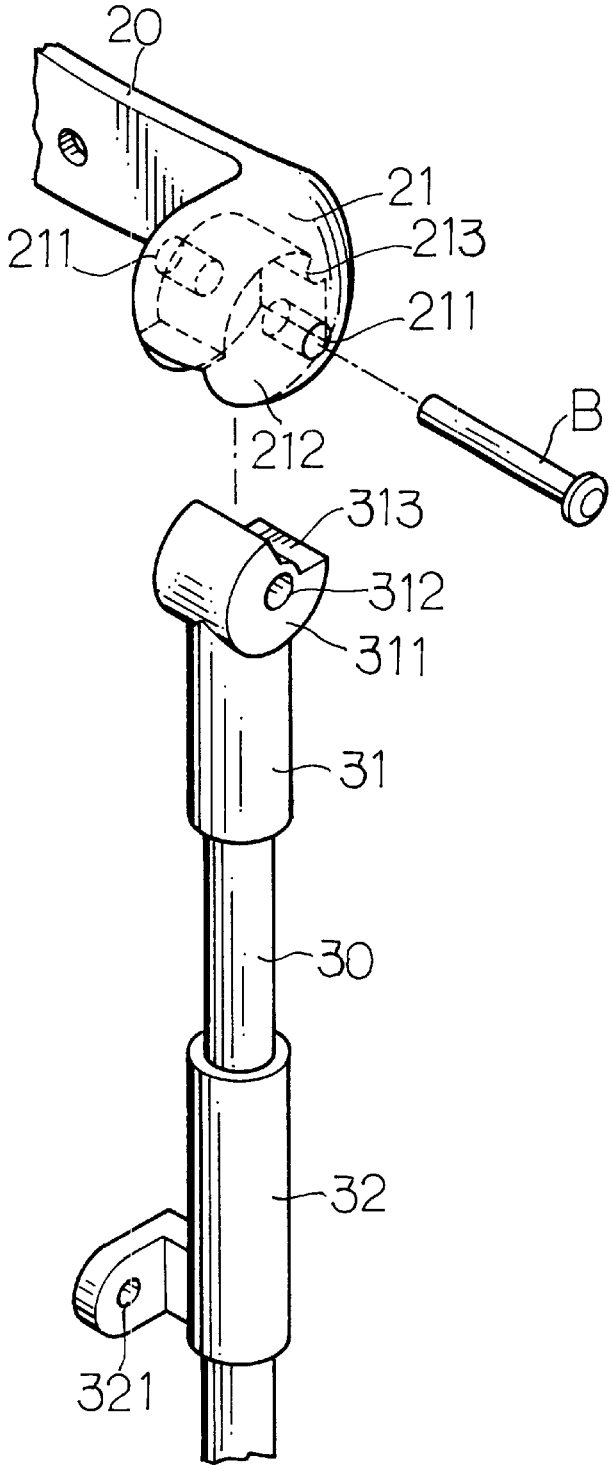
FIG. 2 is an exploded perspective view of attachment device and leg shown in FIG. 1.
Figure 3:
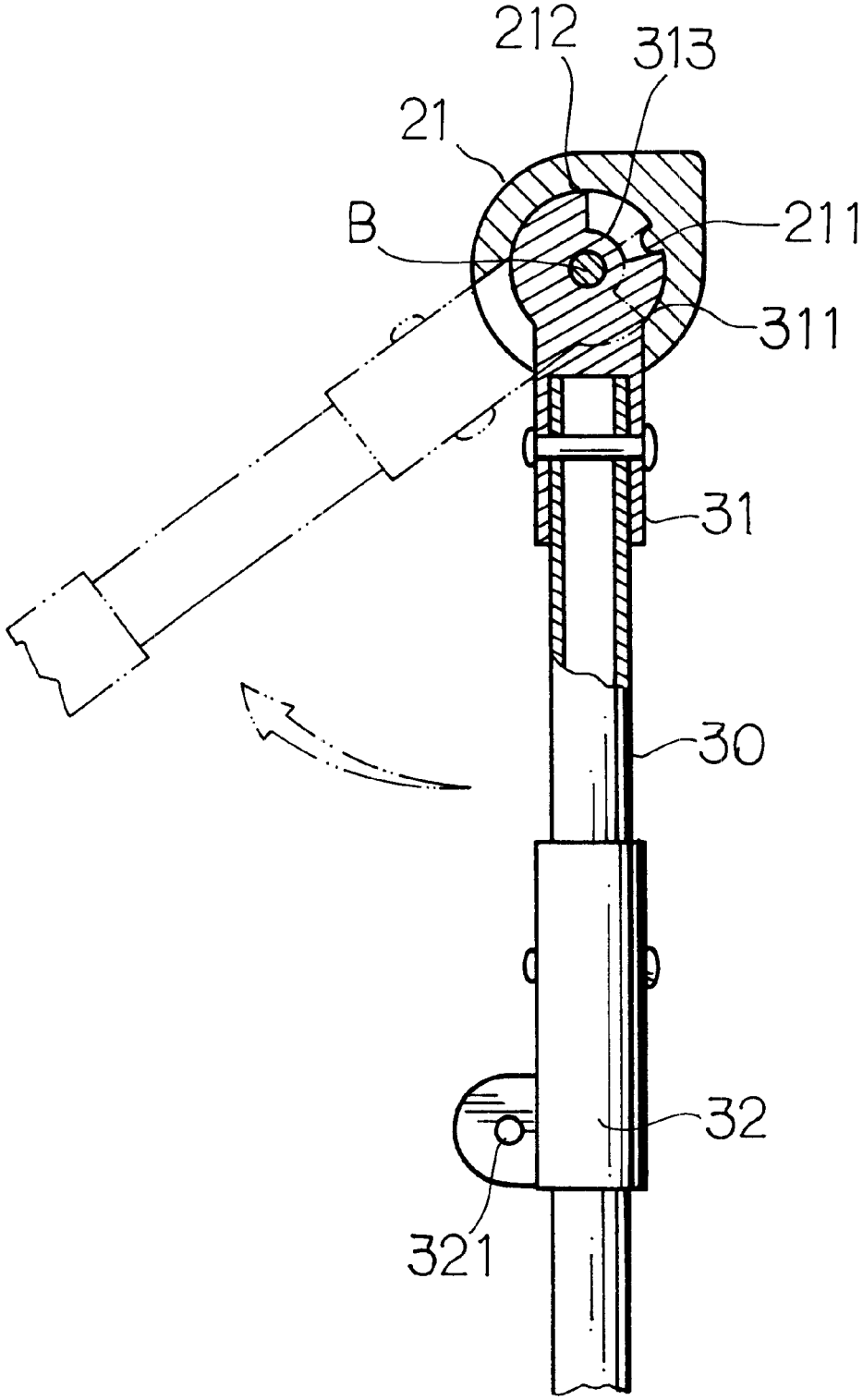
FIG. 3 is side view in part section of the assembled attachment device and leg shown in FIG. 2 for illustrating the operation thereof.
Figure 4:
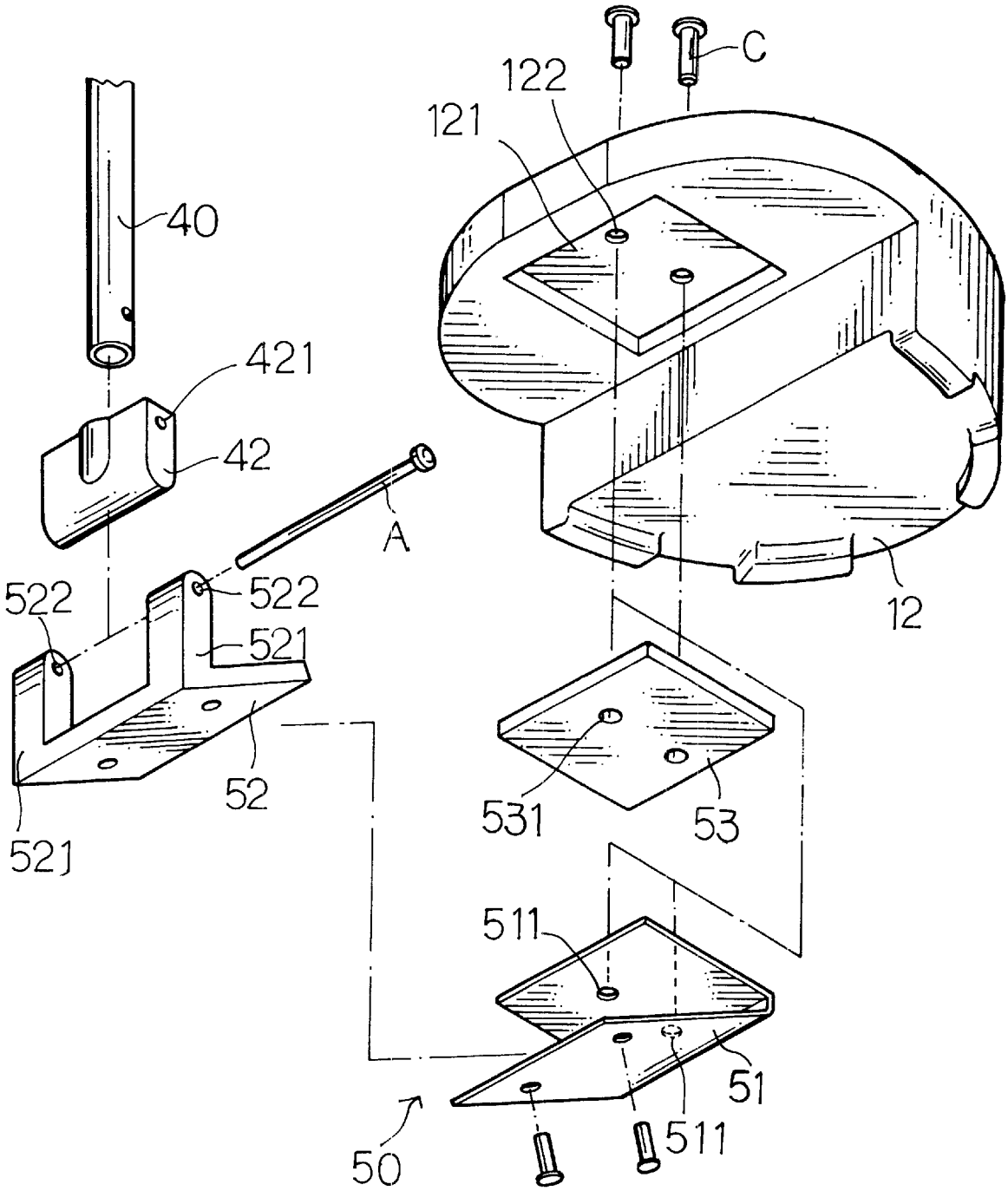
FIG. 4 is an exploded view of base, extension rod, and support device shown in FIG 1.

Referring to FIGS. 1 to 6, there is shown a golf bag support mechanism constructed in accordance with the invention mounted in. a golf bag 10. Components of the support mechanism are detailed below. An elongate attachment device 20 is secured to the back of upper part of golf bag 10. Attachment device 20 comprises an enlargement 21 on either end, each enlargement having a slot 212*h*, a lateral through aperture 211 in communication with slot 212, and a wedge 213 inside the slot 212. Two legs 30 are pivotably provided on either end of attachment device 20. A joint 31 is sleeved on the upper part of leg 30. Joint 31 has a coupling member 311 on the top having a length about equal to that of slot 212, a center hole 312 through the coupling member 311, and a recess 313 conformed to the wedge 213. As such, coupling member 311 of joint 31 may be snugly fitted into enlargement 21. Then insert a rivet B through aperture 211 and hole 312 to pivotably secure leg 30 and attachment device 20 together (see FIGS. 2 and 3). A sleeve 32 below joint 31 is provided on leg 30. Sleeve 32 has a side extension with a hole 321 passed through. An extension rod 40 has a pair of flexible hooks 41 on the upper end each secured to the hole 321 of sleeve 32 and a pivotal member 42 on the lower end having a lateral through hole 421. Base 12 is secured to the bottom of golf bag 10. Base 12 is substantially a cylindrical member having a cutout portion. A rectangular recess 121 is formed on the underside of the cutout portion. A pair of holes 122 are passed through recess 121 (see FIG. 4). A support device 50 comprises a flexible bent member 51 having a plurality of holes 511, an L-shaped member 52 having two spaced posts 521 each having a lateral hole 522 on the upper part, and an abutment member 53 conformed to recess 121 having a pair of holes 531. The assembly of support device 50, extension rod 40, and base 12 will now be described. First place the upper portion of flexible bent member 51 in recess 121. Next urge abutment member 53 against the bottom of the upper portion of flexible bent member 51 in recess 121. Then drive two rivets C through holes 122, 511, and 531 to secure flexible bent member 51, abutment member 53, and base 12 together. Next fit pivotal member 42 into the space between posts 521. Then insert extension rod 40 in the pivotal member 42. Then drive a rivet A through holes 522 and 421 to secure L-shaped member 52 to extension rod 40. finally drive a pair of rivets through holes 511 and the bottom holes of L-shaped member

Figure 5:
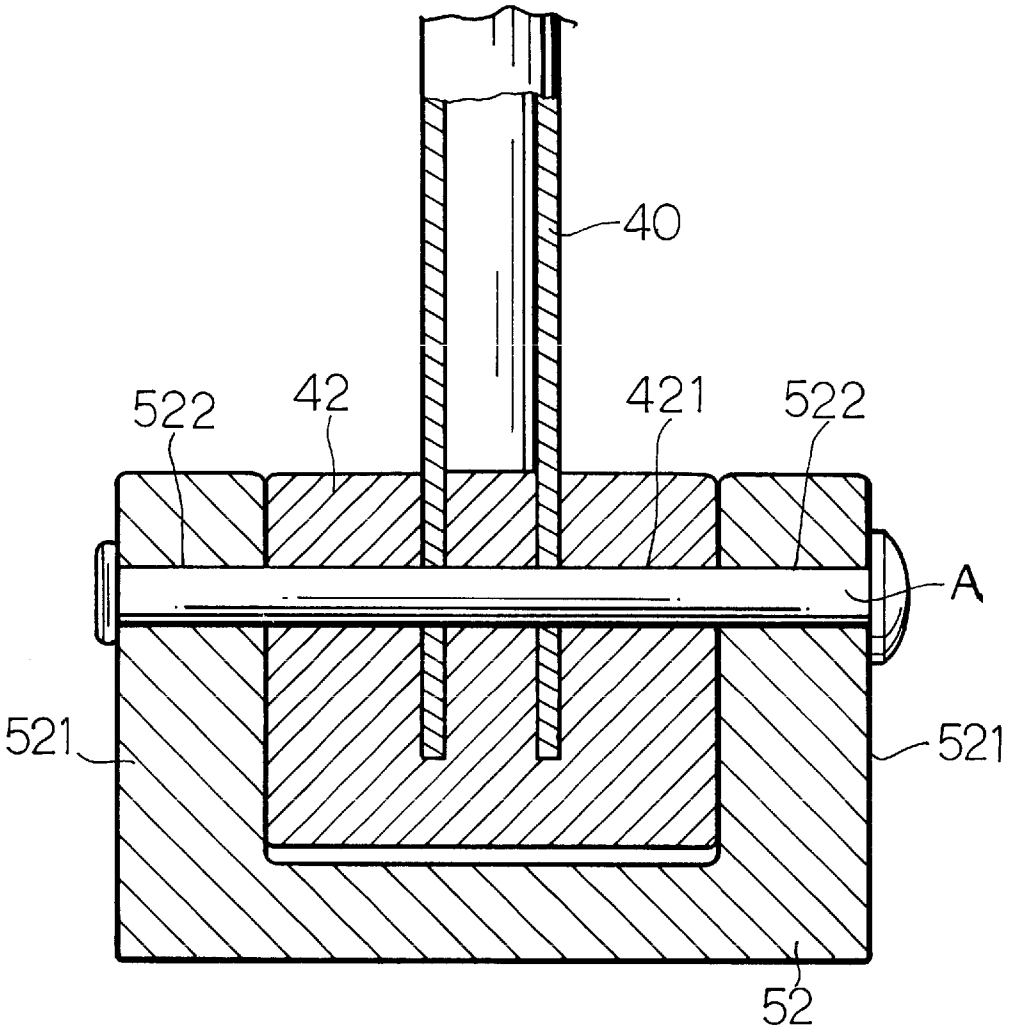
FIG. 5 is a cross-sectional view of the assembled extension rod and support device shown in FIG. 4.
Figure 6:
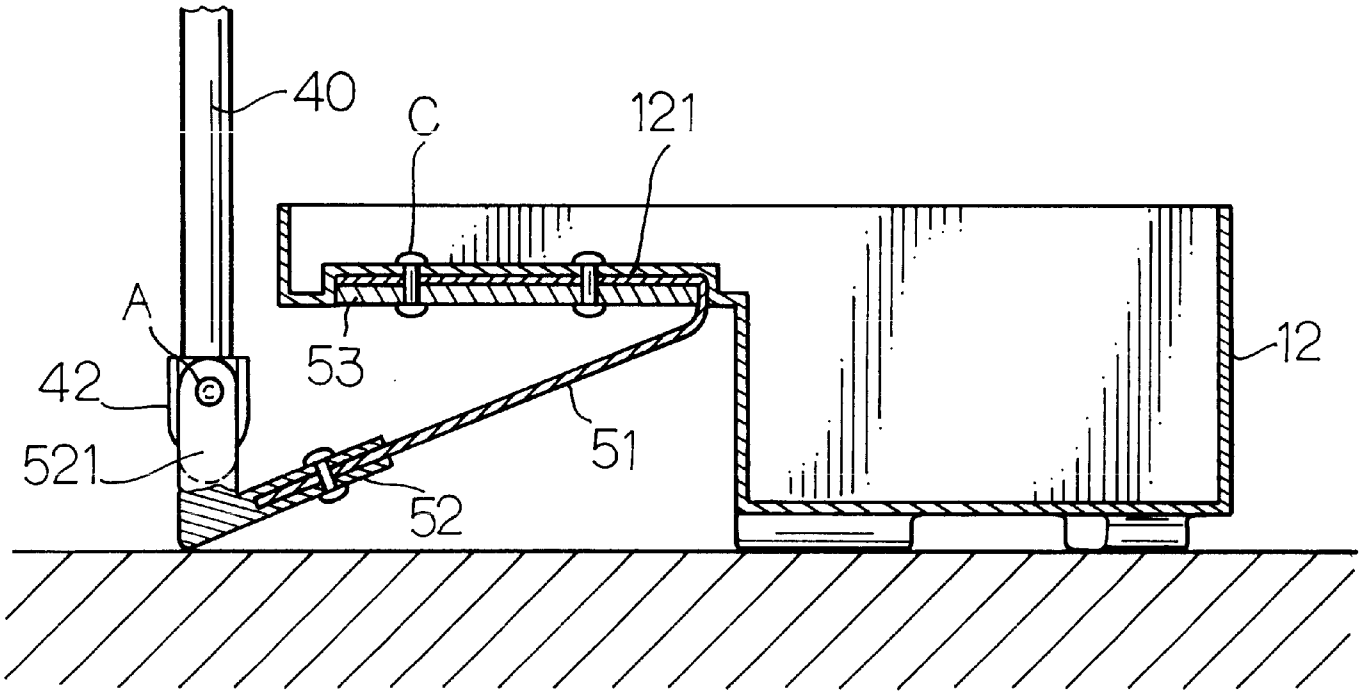
FIG. 6 is a side view in part section of the assembled extension rod and support device mounted in the base shown in FIG. 4.

52 to secure flexible bent member 51 to L-shaped member 52. This completes the assembly of the invention as shown in FIGS. 5 and 6.

Figure 7:
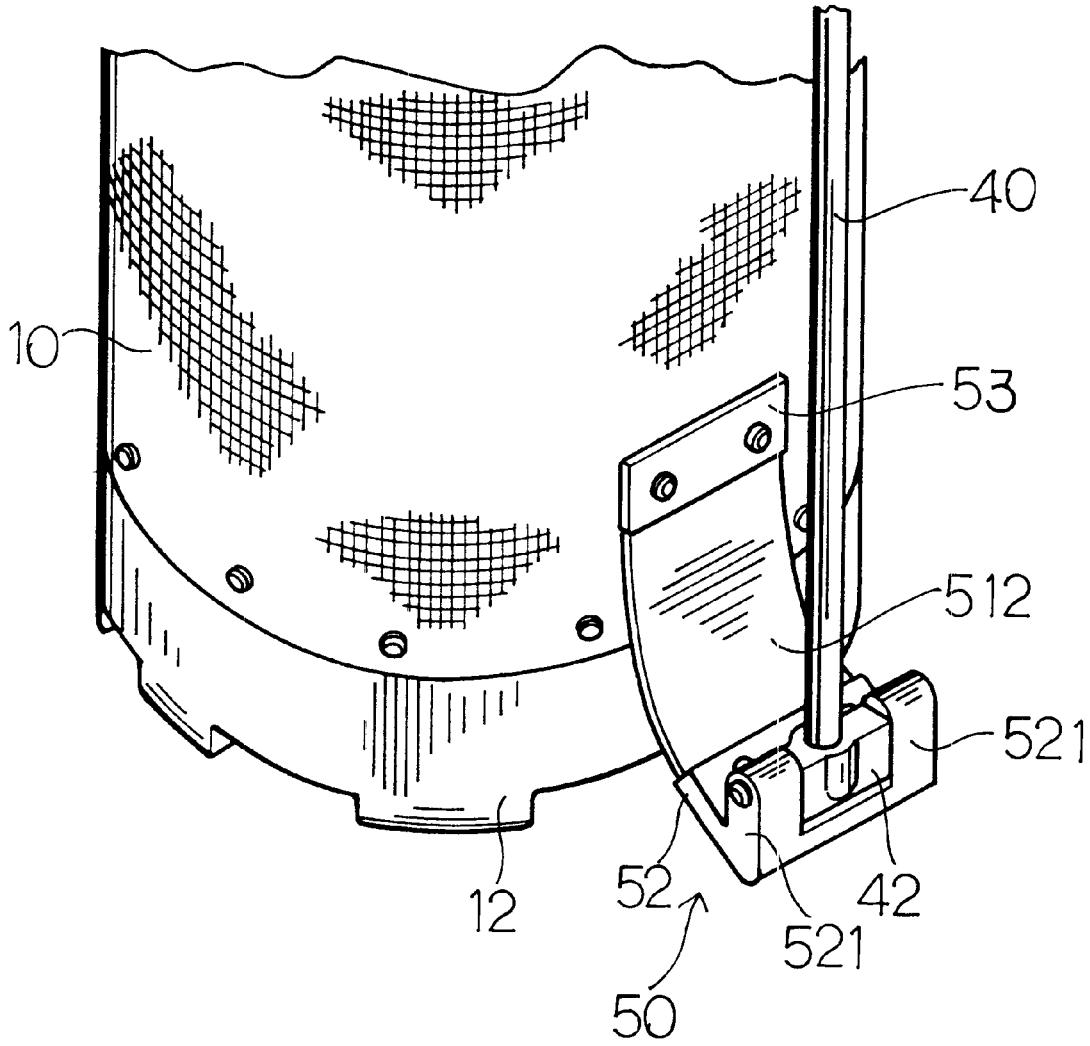
FIG. 7 is a partial perspective view of a second preferred embodiment of golf bag support according to the invention mounted in golf bag.

Referring to FIG. 7, there is shown a perspective view of a second preferred embodiment of golf bag support according to the invention mounted in golf bag 10. The differences between the first and the second embodiments are as follow. The flexible bent member 51 of support device 50 is replaced by an arcuate plate member. The arcuate plate member 51 has one end secured to the peripheral surface of golf bag 10 by means of bolts or rivets.

Figure 8:
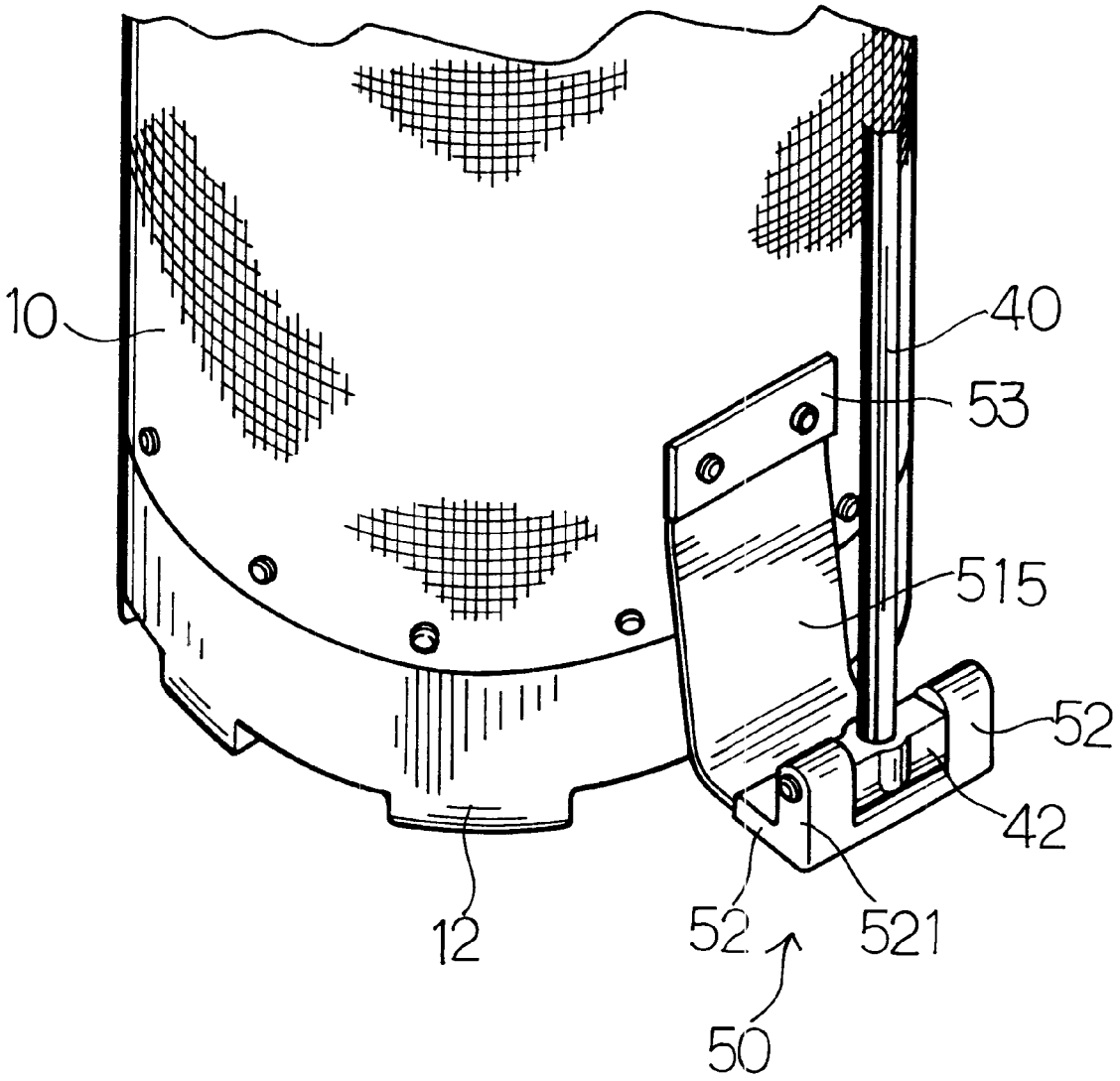
FIG. 8 is a partial perspective view of a third preferred embodiment of golf bag support according to the invention mounted in golf bag.

FIG. 8 is a partial perspective view of a third preferred embodiment of golf bag support according to the invention mounted in golf bag 10. The differences between the second and the third embodiments are as follow. The arcuate plate member 51 in the second embodiment is replaced by an L-shaped plate member in the third embodiment.

Figure 9:
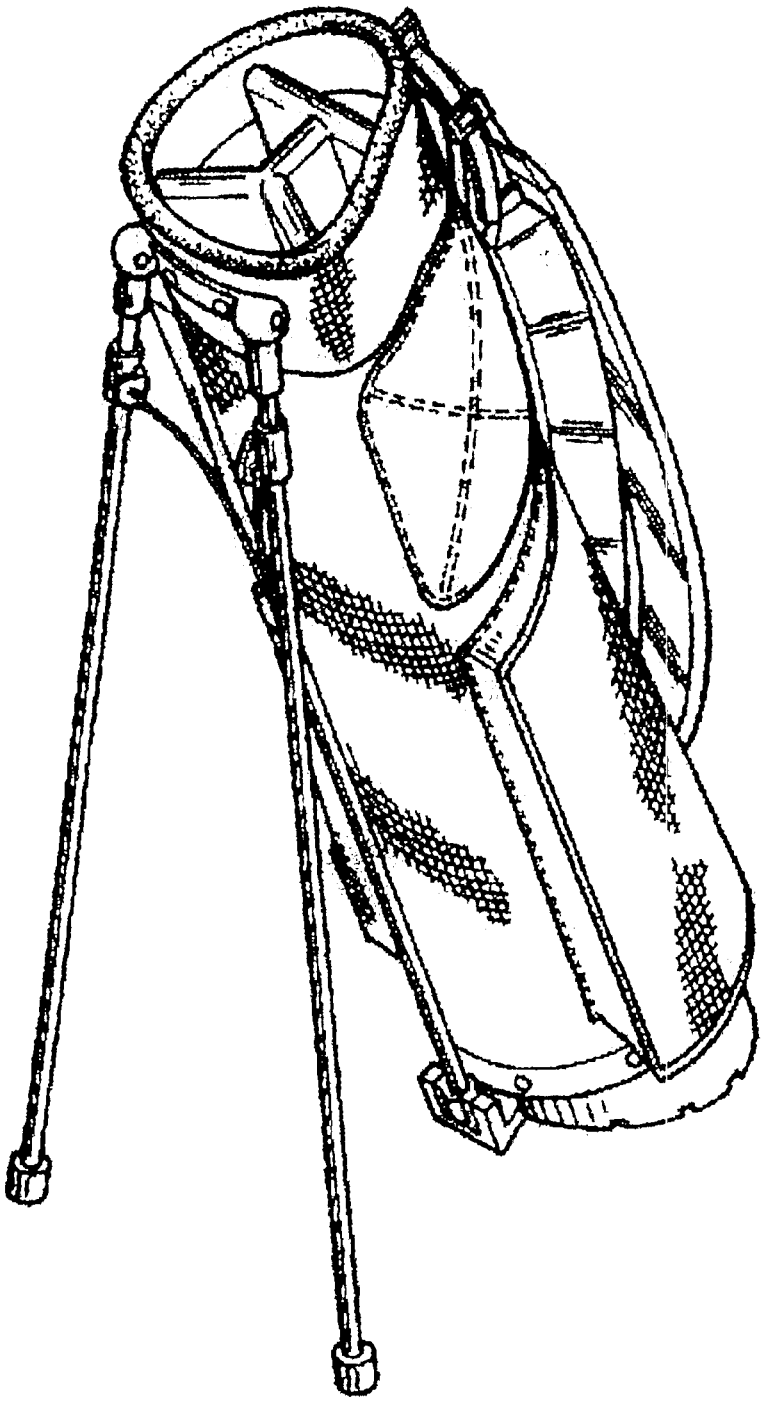
FIG. 9 shows the application of the present invention, where golf support device is extended to support the golf bag.

FIG. 9 shows one application of the present invention, where the golf support device of the present invention is extended to support a golf bag.

While the invention has been described by means of specific embodiments, numerous modifications and variations could be made thereto by those skilled in the art without departing from the scope and spirit of the invention set forth in the claims.

What is claimed is:

1. A support device for a golf bag comprising:

an attachment means secured to the back of the upper part of the golf bag, the attachment means including an enlargement on either end, each enlargement having a slot and a wedge inside the slot;

a pair of legs pivotal on either end of the attachment means, each leg including a sleeve below the top end by a predetermined distance, the sleeve having a side extension, and a joint put on the upper part of each leg, the joint including a coupling member on the top having a length about equal to that of the slot and a recessed portion shaped to conform to the wedge such that the coupling member of the joint is capable of fitting into the enlargement and pivotably securing the leg to the attachment means;

an extension rod including a pair of flexible hooks on the upper end each secured to the side extension of the sleeve and a pivotal member on the lower end;

a base secured to the bottom of the golf bag, the base being substantially a cylindrical member and having a cut-out portion and a recess on the underside of the cut-out portion; and a support means including a flexible member, a substantially L-shaped member having two spaced posts for pivotably engaging the pivotal member of the extension rod, and an abutment member shaped to conform to the recess of the base, wherein the upper portion of the flexible member is secured between the recess of the base and the abutment member and the lower portion of the flexible member is secured to the horizontal portion of the L-shaped member; and the flexible member of the support means has one end secured to the peripheral surface of the golf bag and the other end pivotably secured to the pivotal member of the extension rod.

* * * * *